US006145337A

United States Patent [19]

Wilson

[11] Patent Number: 6,145,337

[45] Date of Patent: Nov. 14, 2000

[54] SYSTEM AND METHOD FOR SECURELY STORING AND TRANSPORTING DETACHABLE PERSONAL ITEMS IN A TRAVEL CASE

[75] Inventor: Nanci Wilson, 6649 Whitemarsh Valley Walk, Austin, Tex. 78746

[73] Assignee: Nanci Wilson, Austin, Tex.

[21] Appl. No.: 09/140,138

[22] Filed: Aug. 25, 1998

[51] Int. Cl.[7] ..... F25D 3/08

[52] U.S. Cl. ..... 62/457.2; 62/457.1; 220/418

[58] Field of Search ..... 62/457.2, 457.1; 220/418

[56] References Cited

U.S. PATENT DOCUMENTS

| | | | |
|---|---|---|---|
| 4,050,264 | 9/1977 | Tanaka | 62/457.2 |
| 4,738,364 | 4/1988 | Yeager | 62/457.1 |
| 5,216,900 | 6/1993 | Jones | 62/457.2 |
| 5,237,838 | 8/1993 | Merritt-Munson | 62/457.2 |
| 5,400,610 | 3/1995 | Macedo | 62/457.2 |
| 5,533,361 | 7/1996 | Halpern | 62/457.2 |
| 5,658,314 | 8/1997 | Scheffer et al. | 62/457.1 |
| 5,797,528 | 8/1998 | McDuffie | 62/457.1 |
| 5,865,314 | 2/1999 | Jacober | 62/457.1 |

*Primary Examiner*—Henry Bennett
*Assistant Examiner*—Mark Shulman

[57] ABSTRACT

This present invention is a storage system for organizing and transporting detachable cosmetics, cosmetic equipment, and other personal items. The system and method for securely storing and transporting detachable cosmetics, cosmetic equipment, and other personal items includes a top cover; a bottom cover hingedly attached to the top cover at a rectangular side; a fastener system for fastening the top cover to the bottom cover in a closed position; an internal lining of touch fastener material on the top cover and the bottom cover; a plurality of touch fastener decals matched to the internal lining of the top and bottom cover to provide a method of attaching cosmetics, cosmetic equipment, and other personal items to the interior of the travel case; and a cooling system proximate to the travel case.

19 Claims, 3 Drawing Sheets

SYSTEM AND METHOD FOR SECURELY STORING AND TRANSPORTING DETACHABLE PERSONAL ITEMS IN A TRAVEL CASE

TECHNICAL FIELD OF THE INVENTION

The present invention relates generally to a field of storing and transporting detachable personal items in a travel case. In particular, this invention relates to a system and method for securely storing and transporting detachable cosmetics, cosmetic equipment, and other personal items in a travel case.

BACKGROUND OF THE INVENTION

Traveling with cosmetics, cosmetic equipment, or other personal items can be very troublesome. These items are typically carried in conventional luggage in a random and disorganized fashion. The transported items are often damaged. One solution has been to use a relatively small travel case which has an upper lid, a tray, and a main central storage compartment. Upon arrival at a destination away from home, such as a hotel, the contents of the case are often removed, organized, and placed on bathroom counters or dresser tops. However, not all travelers have the luxury of these convenient surfaces. Furthermore, the transported items are often bounced, bashed, and broken during travel. At times, the travel case may open and spill the unrestrained items. The cosmetics can also be damaged by the heat due to warm temperatures. The cost of replacing cosmetics melted or damaged by the heat can be considerable.

Thus, there is a need for a small, convenient, multipurpose travel case which can be carried and easily stored while traveling.

There is a need for a small, convenient, multipurpose travel case suited for securely holding and protecting cosmetics, cosmetic equipment, and other personal items from being bounced, bashed, and broken during transport.

There is a need for a small, convenient, multipurpose travel case suited for protecting cosmetics and other personal items from being damaged by the heat due to warm temperatures.

Moreover, there is a need for a small, convenient, multipurpose travel case suited for securely holding cosmetics, cosmetic equipment, and other personal items such that they are visually presented in an organized manner.

SUMMARY OF THE INVENTION

The present invention provides a system and method for organizing and transporting cosmetics, cosmetic equipment, and other personal items, such as a pen or small flashlight, that substantially eliminates or reduces problems and disadvantages associated with previously developed cosmetic travel cases.

More specifically, the present invention provides a system for organizing and transporting detachable cosmetics, cosmetic equipment, and other personal items. The system and method for securely storing and transporting detachable cosmetics, cosmetic equipment, and other personal items includes a top cover; a bottom cover hingedly attached to the top cover at a rectangular side; a fastener system for fastening the top cover to the bottom cover in a closed position; an internal lining of touch fastener material on the top cover and the bottom cover; a plurality of touch fastener decals matched to the internal lining of the top and bottom cover to provide a method of attaching cosmetics, cosmetic equipment, and other personal items to the interior of the travel case; and a cooling system proximate to the travel case.

The present invention provides a technical advantage by protecting the cosmetics or other personal items from damage due to heat from warm temperatures through the use of a cooling system proximate to the travel case.

The present invention provides another technical advantage by restraining and thus preventing the contents of the travel case from being broken due to handling during transport.

The present invention provides another advantage by visually presenting the cosmetics, cosmetic equipment, and other personal items in an organized manner.

The present invention provides another technical advantage by reducing or eliminating the cost of replacing cosmetics or other personal items damaged due to handling during transport.

The present invention provides another technical advantage by allowing the user to stock the travel case with whichever cosmetics, cosmetic equipment, or personal items are desired.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGS. 1 through 5, like numerals being used to refer to like and corresponding parts of the various drawings.

In general as shown in FIGS. 1 through 5, the present invention provides a small, convenient, multipurpose travel case suited for securely holding detachable cosmetics, cosmetic equipment, and other personal items 255. The travel case 100 protects the cosmetics and other personal items 255 from being damaged by warm temperatures. The travel case 100 also restrains and allows the contents to be visually presented in an organized manner.

Figure 1:
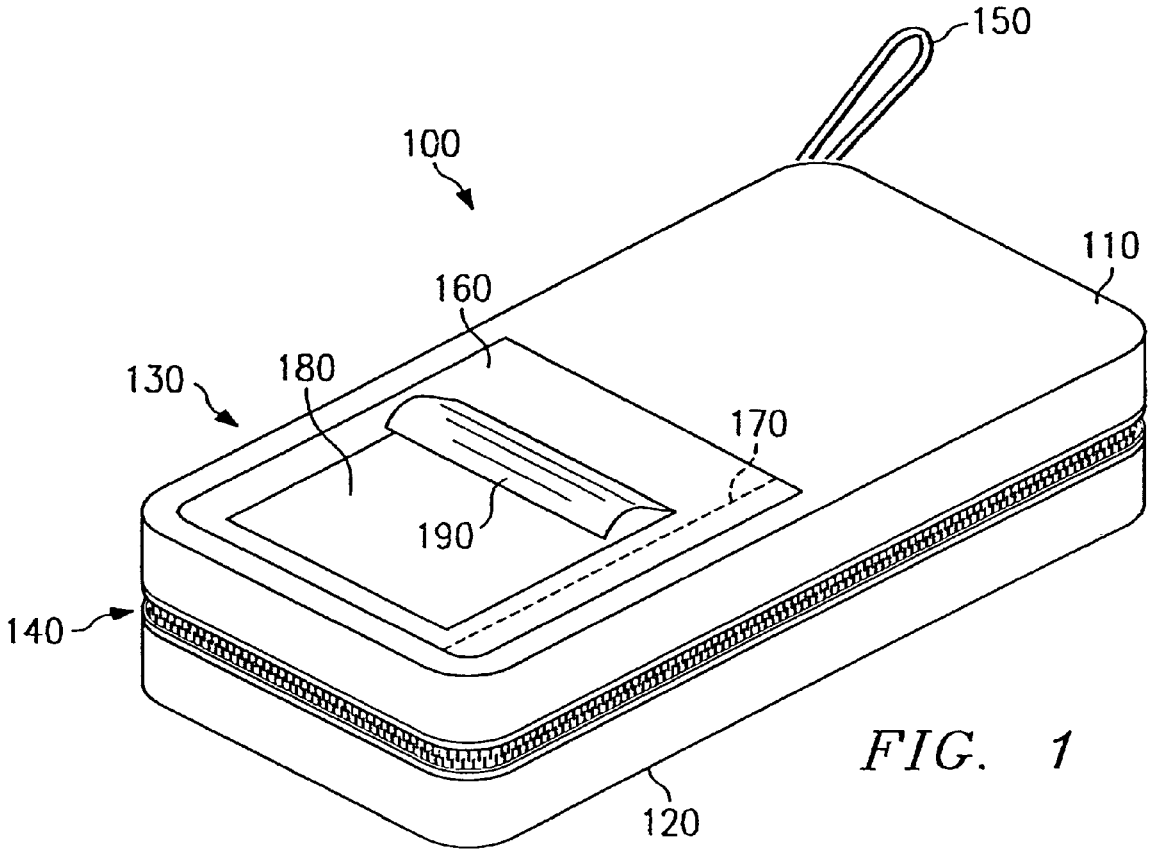
FIG. 1 illustrates the travel case in a folded and closed position.

FIG. 1 illustrates an embodiment of the present invention in the closed position. The travel case 100 is a small, convenient, multipurpose case of a suitable size which can be carried and easily stored when necessary during travel. The exterior shell of travel case 100 is preferably made from at least one piece of a soft, waterproof material having a rectangular top cover 110 hingedly attached to a rectangular bottom cover 120 at rectangular side 130. In the folded position as shown in FIG. 1, the unattached sides can be fastened in the closed position using a fastener system. A nylon zipper closure 140 is illustrated in the present embodiment. An exterior pocket 160 for holding a small note pad can be mounted on either the top cover 110 or bottom cover 120 of the travel case 100. A long narrow exterior pocket 170 can be mounted along side the exterior pocket 160 for the purpose of holding a pen or pencil. Another exterior pocket 180 with a flap 190 to secure the contents of the exterior pocket 180 can be mounted on exterior pocket 160. Additionally, a strap 150 can be externally attached to the travel case 100 wherein the strap 150 may be personalized with a monogram. The strap 150 may be detachable or permanently attached to the travel case 100.

Figure 2:
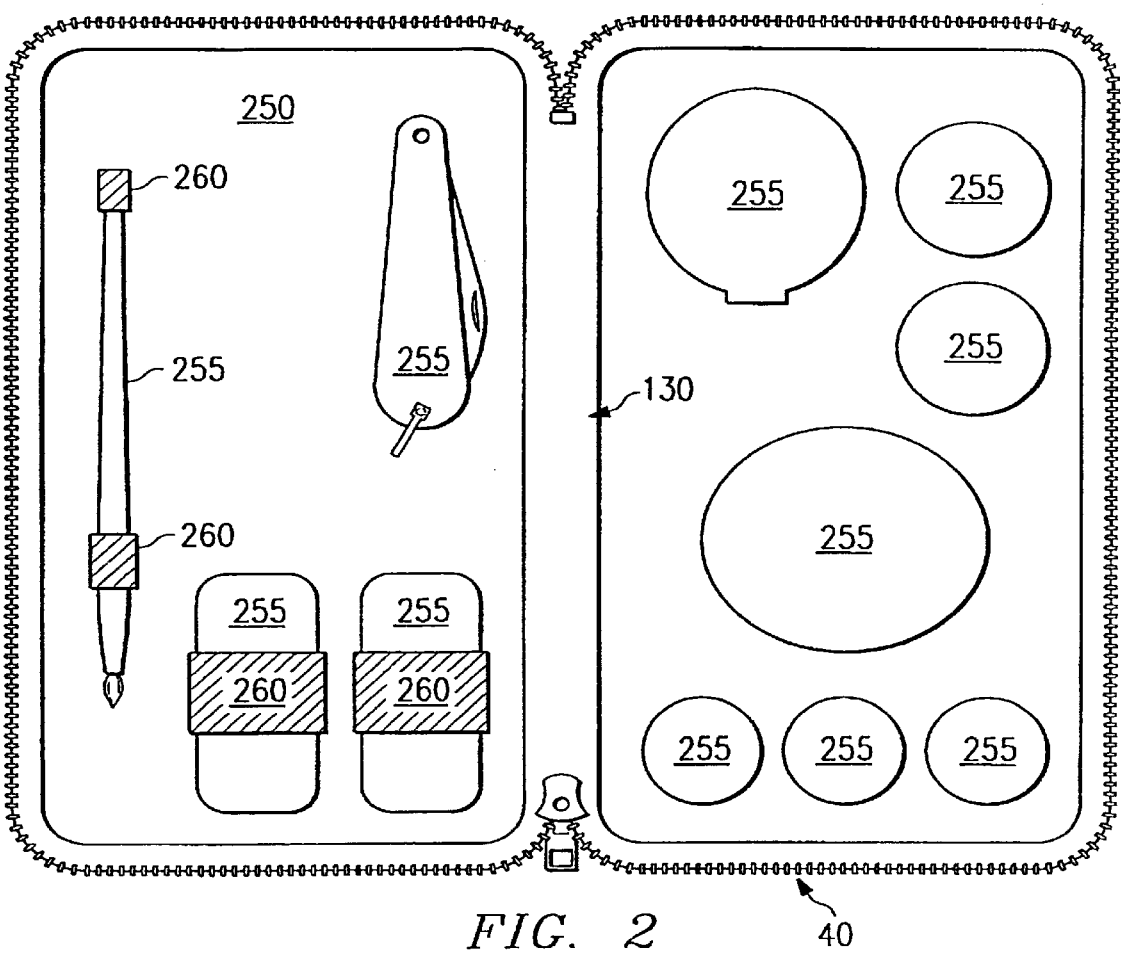
FIG. 2 illustrates the system and method for securely storing cosmetics, cosmetic equipment, and other personal items in the travel case.

FIG. 2 illustrates an embodiment of the present invention in the open position. The interior lining 250 of travel case 100 is preferably made from a touch fastener material such as the hook type sold under the trademark Velcro. The internal lining 250 provides a surface to which cosmetics, cosmetic equipment, and other personal items 255 may be fastened when a second piece of touch fastener material 260, such as the loop type sold under the trademark Velcro, is applied to the cosmetics, cosmetic equipment, or other personal items 255.

The embodiment shown in FIG. 2 allows the user to place whichever cosmetics, cosmetic equipment, or other personal items 255 desired in the travel case 100 since they are all detachable. This is an advantage over prior travel cases which come with a certain brand, type, or color of cosmetics already permanently attached. Whenever the cosmetics in prior cosmetic travel cases have been used up or damaged, a whole new travel case had to be purchased. The present invention allows the user to have more flexibility as to what cosmetics or other personal items go into the travel case.

Figure 3:
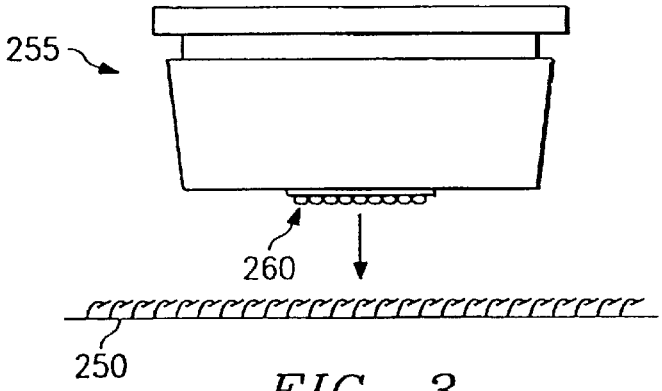
FIG. 3 illustrates how a touch fastener decal might be used to secure cosmetic, cosmetic equipment, or other personal items to the touch fastener lining of the travel case.

FIG. 3 illustrates the cosmetics, cosmetic equipment, or other personal items 255 to which a piece of touch fastener material 260, sold under the trademark Velcro, has been secured to the bottom of the cosmetics or other personal items 255 by an adhesive coating on the backside of the fastener material 260. The cosmetic, cosmetic equipment, or other personal items 255 can then be secured in the case 100 by the touch fasteners 250 and 255. This will allow a user to easily organize the contents of the travel case 100 inside the travel case 100. Furthermore, fastening the cosmetics, cosmetic equipment, and other personal items 255 inside the travel case 100 will keep them from being bounced, bashed, and broken during travel, handling, or storage. This can clearly reduce or eliminate the cost of replacing cosmetics or other personal items 255 which would have been damaged inside prior travel cases.

Figure 4:
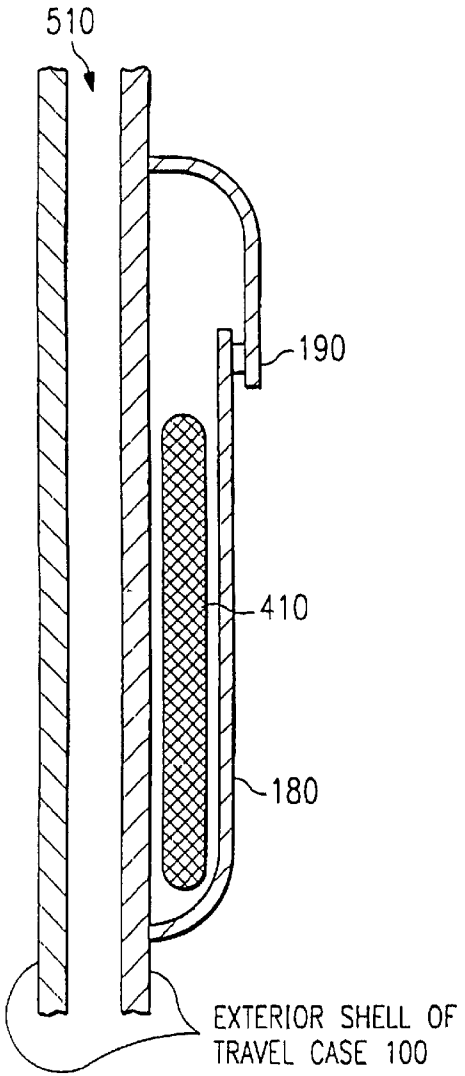
FIG. 4 illustrates a typical vertical cross-sectional view of an illustrative pocket and flap mounted on the exterior of the travel case containing a refrigerant gel package.

FIG. 4 illustrates one embodiment of the present invention which protects the contents of the travel case 100 from being damaged by the heat due to warmer temperatures. External pocket 180 is shown with securing flap 190. A removable refrigerant gel package 410 may be frozen and placed inside the exterior pocket 180. Refrigerant gel package 410 can be readily reused. Refrigerant gel is disclosed by way of example, in U.S. Pat. No. 2,803,115.

In an alternative embodiment, the refrigerant gel package 410 may be incorporated into a sandwich layer in the external shell as illustrated in FIG. 4. FIG. 4 illustrates a cross-sectional view of an exterior pocket on either the top cover 110 or the bottom cover 120 of the travel case 100 which contains a refrigerant gel package 410. A sandwich layer 510 may be constructed of different materials such as insulation, a flexible refrigerant gel material, padding, or any combination thereof to help control the internal temperature of the travel case 100 and protect its contents. The exterior shell of the travel case 100 is preferably made from at least one piece of a soft waterproof material.

Figure 5:
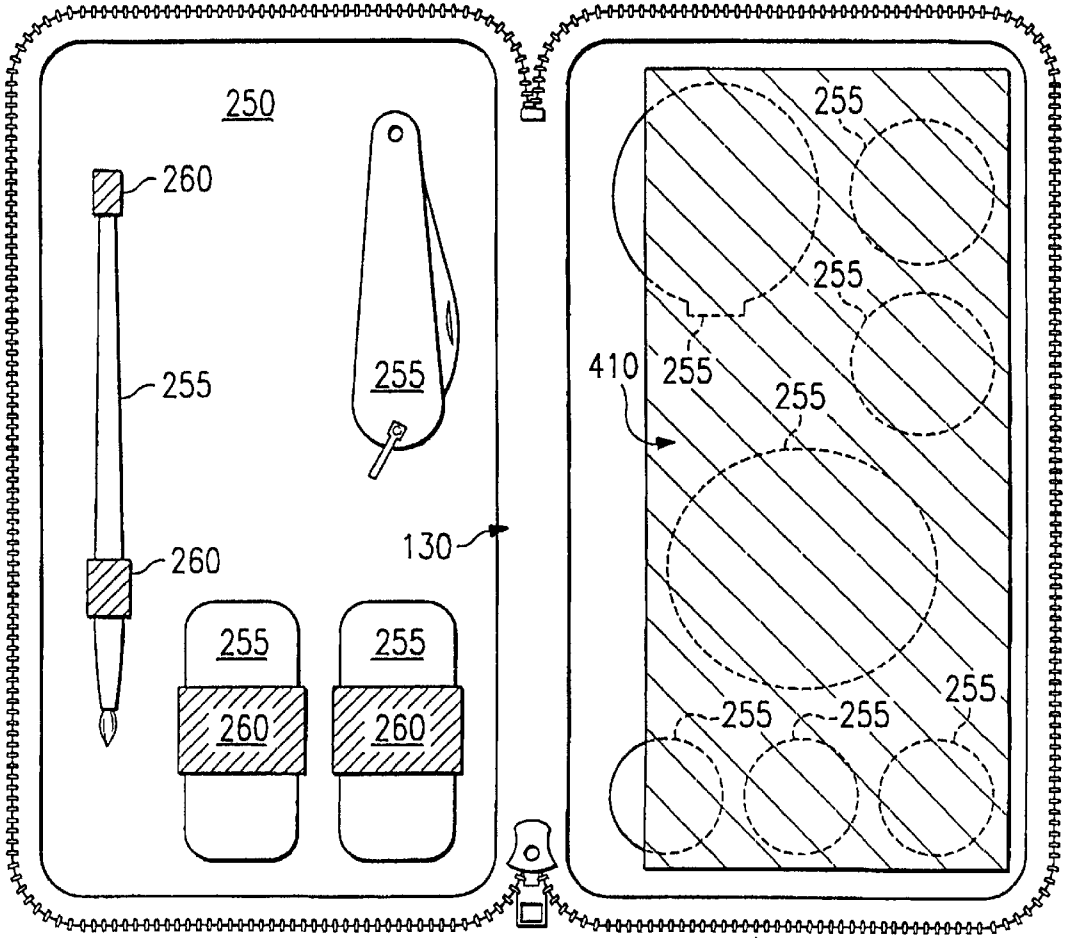
FIG. 5 illustrates the travel case in an unfolded open position with a refrigerant gel package placed inside to keep the cosmetics cool during warm temperatures.

FIG. 5 illustrates another embodiment of the present invention which protects the contents of the travel case 100 from being damaged by the heat due to warmer temperatures. In FIG. 5, travel case 100 is shown in an unfolded, open position with a frozen refrigerant gel package 410 placed inside on top of the cosmetics or other personal items 255 to keep them cool. Refrigerant gel package 410 can be readily reused. Refrigerant gel is disclosed by way of example in U.S. Pat. No. 2,803,115.

In summary, the present invention provides a system and method for organizing and transporting cosmetics, cosmetic equipment, and other personal items 255. The system includes a top cover 110 which is hingedly attached to a bottom cover 120 at rectangular side 130. An internal touch fastener system is employed for securely holding the detachable contents of the travel case 100 in a fixed position. The present invention provides an important technical advantage by providing a small, convenient, multipurpose travel case 100 which can be carried and easily stored when necessary. Furthermore, the present invention protects the contents of the travel case 100 from being damaged due to the heat of warmer temperatures; restrains and protects the contents from being broken during handling and transport; and visually presents the contents in an organized manner. Thus, the cost of replacing damaged cosmetics or other personal items 255 is reduced or eliminated.

Although the present invention has been described in detail, it should be understood that various changes, substitutions and alterations can be made hereto without departing from the spirit and scope of the invention as described by the appended claims.

What is claimed is:

1. A system for organizing and transporting a plurality of personal items, comprising;

a top cover having an inner and outer surface;

a bottom cover having an inner and outer surface hingedly attached to the top cover;

a touch fastener system lining the inner surface of the top cover and the bottom cover for securely holding a plurality of personal items in a fixed position with touch fasteners by one of attaching the touch fastener to the personal item and securing the personal item to the touch fastener system and by placing at least one touch fastener across at least a portion of the personal item and securing a first and second end of the at least one fastener to the touch fastener system, therein each personal item may be removed and replaced with the same or a different personal item.

2. The system of claim 1, further comprising a fastener system for fastening the top cover to the bottom cover in a closed position.

3. The system of claim 2, wherein the fastener system is comprised of a zipper.

4. The system of claim 1, further comprising a plurality of storage pockets mounted on either the top or bottom cover.

5. The system of claim 1, wherein the cooling system consists of at least one refrigerant gel package located inside at least one exterior storage pocket.

6. The system of claim 1, wherein the cooling system consists of at least one refrigerant gel package located inside the travel case.

7. The system of claim 1, further comprising a strap externally attached to the travel case wherein the strap may be monogrammed.

8. The system of claim 7, wherein the strap attached to the travel case is detachable.

9. The system of claim 1, wherein the touch fastener system uses a hook and loop type touch fastener.

10. The system of claim 1, wherein the exterior top cover, bottom cover, and rectangular side are comprised of a suitable waterproof material.

11. The system of claim 1, wherein the personal items can be cosmetics, cosmetic equipment, pens, pencils, a small flashlight, or a number of other personal items.

12. A method for organizing and transporting detachable cosmetics, cosmetic equipment, and other personal items, comprising:

forming a container by hingedly attaching a top cover and a bottom cover at a rectangular side;

fastening the top cover to the bottom cover to seal the container;

lining the inside of the container with a touch fastener material;

securing detachable personal items inside the container with touch fastener decals;

storing personal items in a plurality of storage pockets mounted on either the top or bottom cover; and removing and replacing personal items with the same or different personal items as desired.

13. The method of claim 12, further comprising the step of attaching a strap to the travel case wherein the strap can be monogrammed.

14. The method of claim 12, wherein the step of protecting the cosmetics and other personal items from the heat due to warm temperatures is accomplished by placing at least one refrigerant gel package proximate to the travel case.

15. The method of claim 12, further comprising the step of lining the top cover, bottom cover, and rectangular sides with a suitable waterproof material.

16. The method of claim 12, wherein the step of fastening the top cover to the bottom cover uses a zipper to fasten the top cover to the bottom cover.

17. The method for organizing and transporting detachable cosmetics according to claim 12, wherein the cosmetics and other personal items are protected from heat due to warm temperatures by incorporating a cooling system proximate to the travel case.

18. The method of claim 12, wherein the step of fastening the top cover to the bottom cover uses a zipper to fasten the top cover to the bottom cover.

19. The system for organizing and transporting a plurality of personal items according to claim 1, wherein a cooling system is disposed between the top and bottom cover, wherein the cooling system protects the personal items from being damaged from heat due to warm temperatures.

* * * * *